US007837500B2

(12) United States Patent
Chen

(10) Patent No.: US 7,837,500 B2
(45) Date of Patent: Nov. 23, 2010

(54) FIXTURE FOR MOUNTING AN ELECTRICAL CONNECTOR

(75) Inventor: Hui-Chun Chen, Taipei Hsien (TW)

(73) Assignee: Wistron Corporation, Taipei Hsien (TW)

( * ) Notice: Subject to any disclaimer, the term of this patent is extended or adjusted under 35 U.S.C. 154(b) by 0 days.

(21) Appl. No.: 12/318,886

(22) Filed: Jan. 12, 2009

(65) Prior Publication Data

US 2009/0239404 A1 Sep. 24, 2009

(30) Foreign Application Priority Data

Mar. 19, 2008 (TW) ..... 97204674 U

(51) Int. Cl.
*H01R 13/73* (2006.01)

(52) U.S. Cl. ..... 439/564

(58) Field of Classification Search ..... 439/564, 439/562, 565, 527, 532, 575
See application file for complete search history.

(56) References Cited

U.S. PATENT DOCUMENTS 5,637,015 A * 6/1997 Tan et al. ..... 439/607.37
5,709,569 A * 1/1998 Buck et al. ..... 439/607.01
5,718,605 A * 2/1998 Morikawa et al. ..... 439/607.27
5,741,147 A * 4/1998 Konoya et al. ..... 439/189
5,772,471 A * 6/1998 Buck ..... 439/607.28
5,980,313 A * 11/1999 Kunishi et al. ..... 439/545
6,231,385 B1 * 5/2001 Kuo ..... 439/557
6,364,706 B1 * 4/2002 Ando et al. ..... 439/607.37
6,386,918 B1 * 5/2002 Zheng et al. ..... 439/607.45
6,533,612 B1 * 3/2003 Lee et al. ..... 439/564
6,796,839 B1 * 9/2004 Wu ..... 439/607.01
6,863,545 B2 * 3/2005 Peloza ..... 439/79
6,875,052 B1 * 4/2005 Lo et al. ..... 439/564
6,986,681 B2 * 1/2006 Tsai ..... 439/607.36
7,029,331 B1 * 4/2006 Lai ..... 439/607.35
7,037,135 B2 * 5/2006 Chen et al. ..... 439/607.08
7,074,084 B2 * 7/2006 Shuey et al. ..... 439/607.32
7,081,013 B2 * 7/2006 Yamaguchi et al. ..... 439/562
7,118,414 B2 * 10/2006 Spears et al. ..... 439/540.1
7,140,903 B2 * 11/2006 Pulizzi et al. ..... 439/371
7,179,125 B2 * 2/2007 Chen et al. ..... 439/607.28
7,190,590 B2 * 3/2007 Karuishi ..... 361/719
7,217,146 B2 * 5/2007 Meister et al. ..... 439/148
7,264,507 B2 * 9/2007 Beckman et al. ..... 439/607.37
7,303,432 B1 * 12/2007 Chen et al. ..... 439/540.1
7,338,297 B2 * 3/2008 Maegawa et al. ..... 439/79
7,559,788 B2 * 7/2009 Legg ..... 439/373
2002/0068477 A1 * 6/2002 Chen-Chiang et al. ..... 439/373

(Continued)

*Primary Examiner*—T C Patel
*Assistant Examiner*—Vladimir Imas
(74) *Attorney, Agent, or Firm*—Bacon & Thomas, PLLC

(57) ABSTRACT

The present invention relates to a fixture capable of fixing a USB connector on a housing. The fixture comprises a housing connection surface, a top surface, a first lateral surface, and a second lateral surface, wherein the housing connection surface is capable of being fixed on the housing; the top surface is connected to the housing connection surface where both surfaces are substantially perpendicular to each other, and the top surface comprises a first constraining unit capable of contacting a protection part of the USB connector to constrain movement of the USB connector along a first direction; the first lateral surface is connected to the top surface to constrain movement of the USB connector; and the second lateral surface is connected to the top surface to constrain movement of the USB connector.

16 Claims, 4 Drawing Sheets

U.S. PATENT DOCUMENTS

2003/0040221 A1* 2/2003 Lee et al. ..... 439/607
2003/0129864 A1* 7/2003 Peloza ..... 439/79
2005/0164548 A1* 7/2005 Spears et al. ..... 439/540.1
2006/0025015 A1* 2/2006 Hu et al. ..... 439/607
2006/0094293 A1* 5/2006 Daggett et al. ..... 439/544
2006/0148300 A1* 7/2006 Huang et al. ..... 439/353
2007/0178734 A1* 8/2007 Chen ..... 439/172
2007/0178735 A1* 8/2007 Chen ..... 439/172
2007/0190855 A1* 8/2007 Meister et al. ..... 439/595

* cited by examiner

FIXTURE FOR MOUNTING AN ELECTRICAL CONNECTOR

BACKGROUND OF THE INVENTION

1. Field of the Invention

The present invention relates to a fixture, and especially relates to a fixture capable of fixing a USB connector on a housing.

2. Description of the Related Art

Conventionally, a USB connector of a computer, which provides electrical connection to external electronic devices, is fixed on a circuit board by welding. The USB connector is aligned to a housing after the circuit board is installed on the computer. Since the USB connector is directly mounted on the circuit board, the USB connector is fixed as long as the circuit board is fixed in a socket.

However, when a cover (for example a decorative cover) is put on the housing, there is a gap between the housing and the cover (about 1.5 cm for instance). If the USB connector is mounted at one side of the circuit board, it is difficult to set the front end of the USB connector in the proper position; in other words, the front end of the USB connector cannot easily be aligned with the cover.

In addition, if the circuit board is installed in the computer with a tray, the dimensions of the circuit board must meet the requirements of the tray. In addition, structural interference may occur because the USB connector welded on the circuit board protrudes. Therefore, it may be difficult to install the circuit board in the computer.

The prior art provides a USB connector having a wire to solve the problem caused by the gap between the housing and the cover, and the problem caused by the structural interference. However, as a result of the USB connector being subjected to regular plug/unplug operations, the wire of the USB connector may be damaged. In the prior art, the fixing effect of the USB connector is not sufficiently good. More particularly, the fixture of the prior art cannot constrain movement of the USB connector along the X-axis, Y-axis, and Z-axis stably.

Therefore, it is necessary to provide a fixture to solve the problems of the prior art.

SUMMARY OF THE INVENTION

It is therefore an object of the present invention to provide a fixture for fixing a USB connector on a housing.

To achieve the first object mentioned above, the fixture comprises a housing connection surface, a top surface, a first lateral surface, and a second lateral surface wherein the housing connection surface is capable of being fixed on the housing; the top surface is connected to the housing connection surface where both surfaces are perpendicular to each other; and the top surface comprises a first constraining unit capable of contacting a protection part of the USB connector to constrain movement of the USB connector along a first direction; the first lateral surface is connected to the top surface to constrain movement of the USB connector; and the second lateral surface is connected to the top surface to constrain movement of the USB connector.

According to an embodiment of the present invention, the first lateral surface comprises a first stop part and a second stop part, and there is a step between the first stop part and the second stop part. The second stop part comprises a stop edge capable of contacting a front edge of the base of the USB connector to constrain movement of the USB connector along a second direction wherein the first direction is substantially opposite to the second direction.

Other objects, advantages, and novel features of the present invention will become more apparent from the following detailed description when taken in conjunction with the accompanying drawings.

BRIEF DESCRIPTION OF THE DRAWINGS

These and other objects and advantages of the present invention will become apparent from the following description of the accompanying drawings, which disclose several embodiments of the present invention. It is to be understood that the drawings are to be used for purposes of illustration only, and not as a definition of the invention.

In the drawings, wherein similar reference numerals denote similar elements throughout the several views.

DETAILED DESCRIPTION OF THE PREFERRED EMBODIMENT

Figure 1:
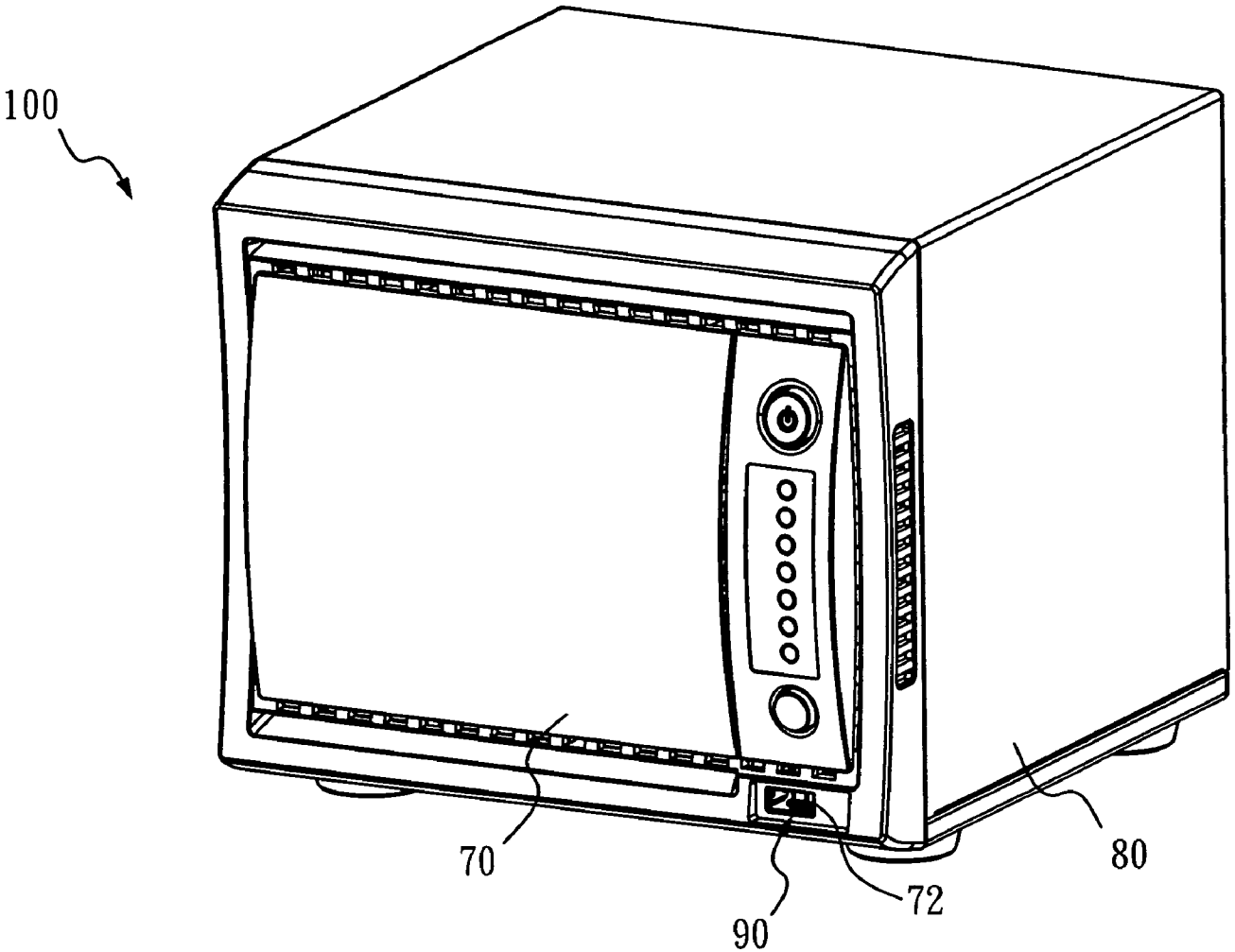
FIG. 1 is an illustration of a computer.
Figure 2:
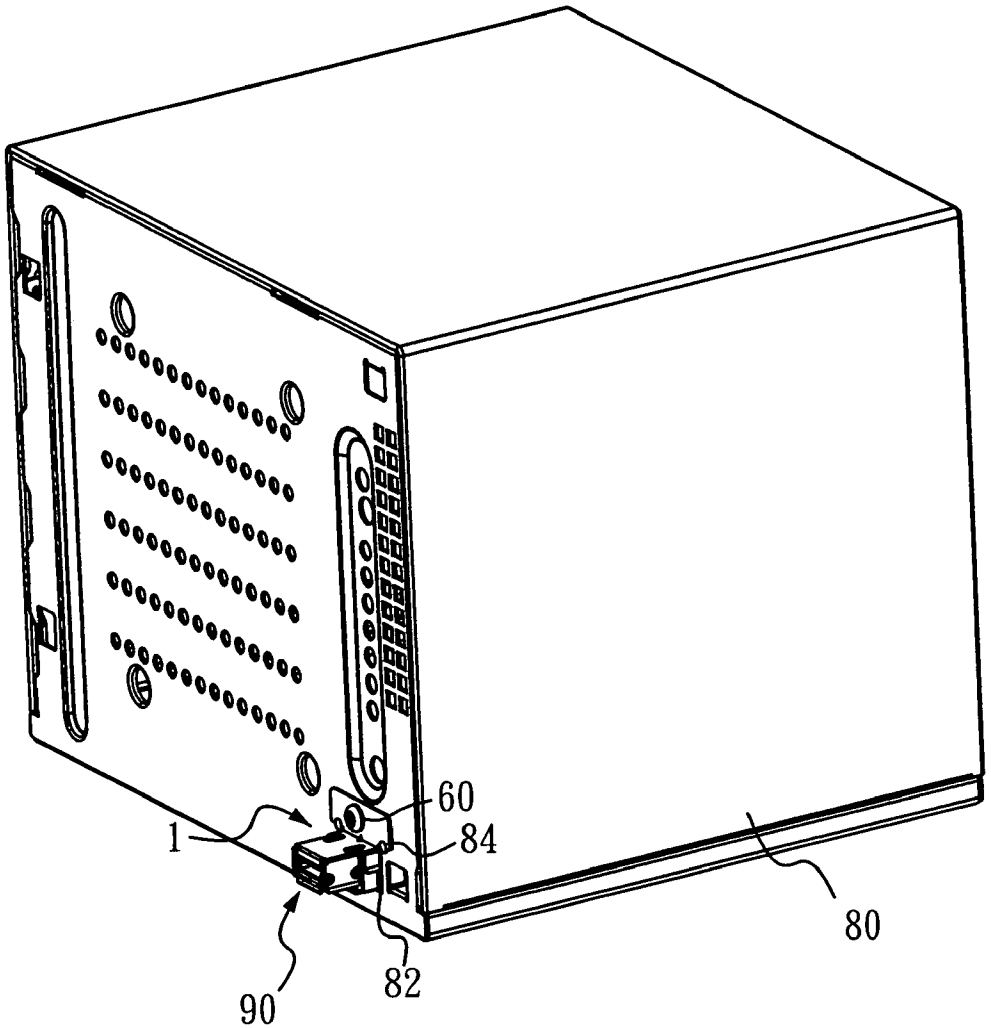
FIG. 2 is an illustration of the computer after removal of its cover.

Please refer to FIG. 1 and FIG. 2. FIG. 1 is an illustration of a computer, and FIG. 2 is an illustration of the computer after removing its cover. The fixture 1 of the present invention is capable of fixing a USB connector 90 on a housing 80.

As shown in FIG. 1, the computer 100 comprises a housing 80 and a cover 70, wherein the cover 70 has an opening 72 located at the installation position of the USB connector 90 (as shown in FIG. 2). More particularly, a front end (namely protection parts 96, 96*a*) of the USB connector 90 is aligned to the opening 72 of the cover 70; therefore, the USB connector 90 protrudes above the housing 80. An external electronic device, such as a USB memory drive, can be electrically connected to the computer 100 via the USB connector 90 for transmitting data between the external electronic device and the computer.

Figure 4:
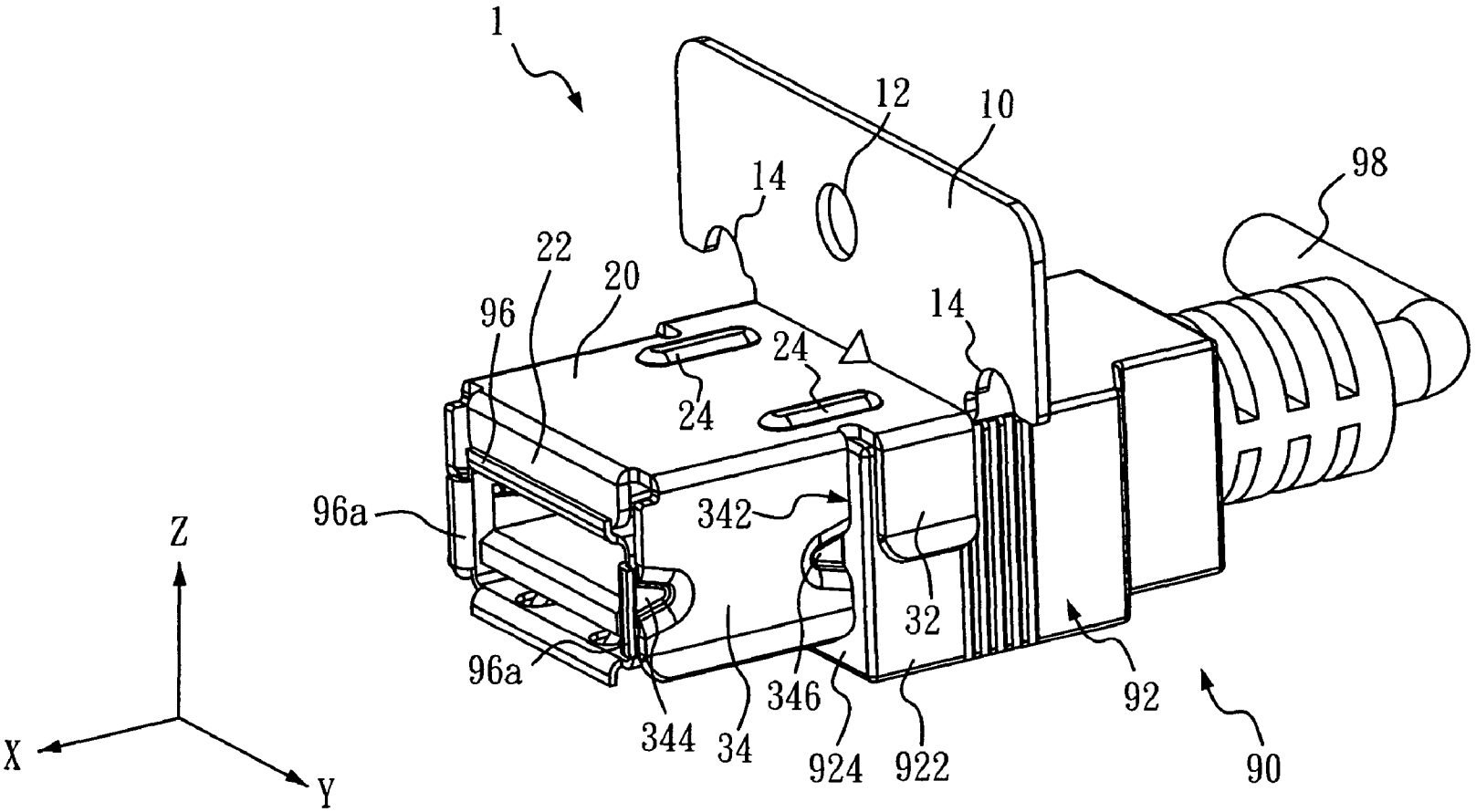
FIG. 4 is an illustration of the fixture of the present invention and the USB connector after assembly.

As shown in FIG. 2, a lower edge of an opening 82 of the housing 80 is capable of constraining movement of the USB connector along the vertical direction (the Z-axis as shown in FIG. 4). The effect of constraining movement of the USB connector along the Z-axis can be better if the lower edge of the opening 82 of the housing 80 were perpendicularly extended outward and form a supporting plane (not shown in FIG).

Figure 3:
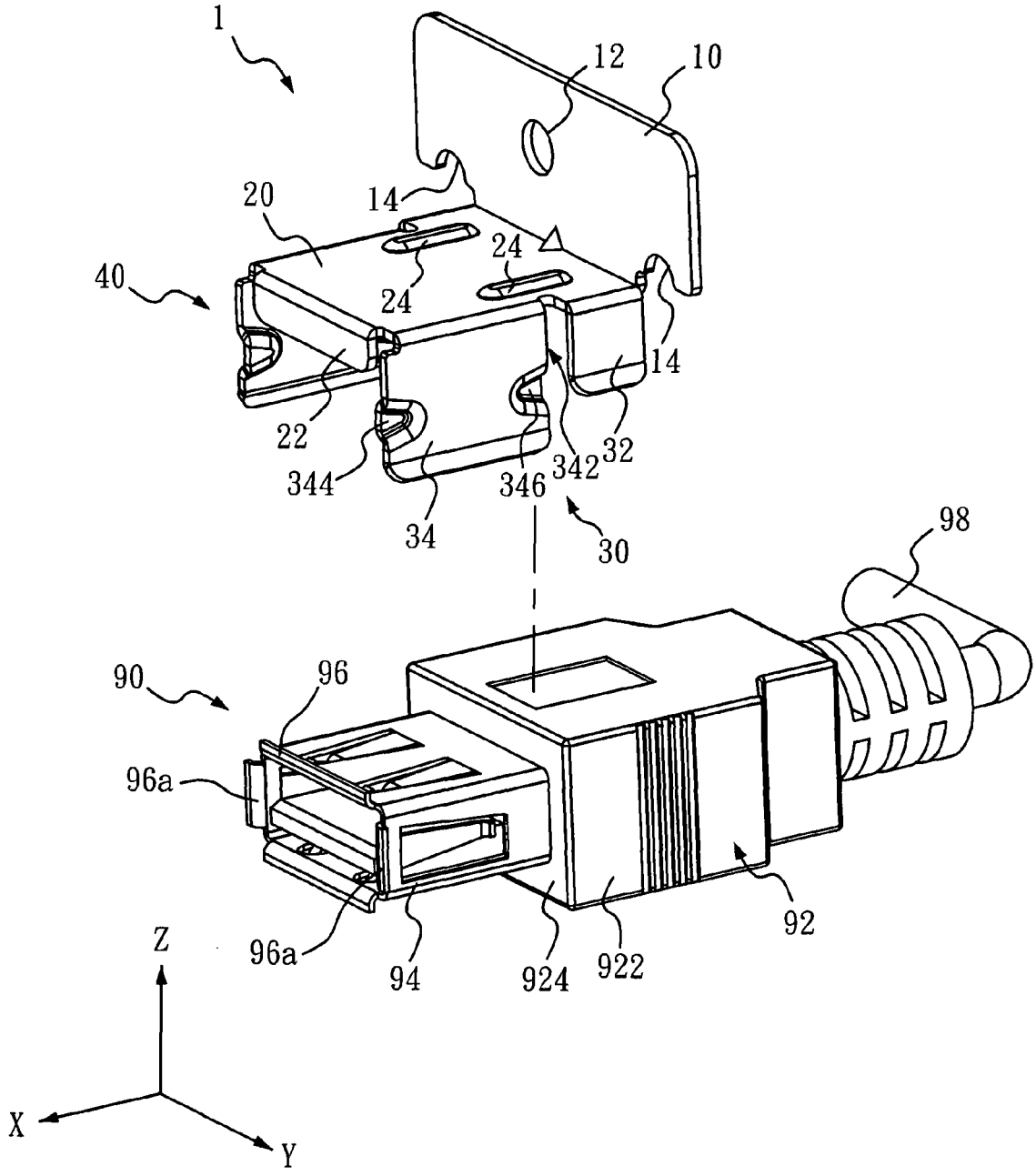
FIG. 3 is an explosive view of a fixture of the present invention and a USB connector.

Please refer to FIG. 3 and FIG. 4 together. FIG. 3 is an explosive view of the fixture and the USB connector, and FIG. 4 is an illustration of the fixture and the USB connector after assembly. The USB connector 90 is a general electrical connector. The USB connector 90 comprises a base 92, a connection part 94, and protection parts 96, 96*a*, wherein the base 92 comprises a side edge 922 and a front edge 924. An end of the connection part 94 is fixed on the front edge 924 of the base 92, and the other end of the connection part 94 is connected to the protection parts 96, 96*a*. The connection part 94 and the protection parts 96, 96*a* are for electrical connection with external electrical devices, such that the electrical signal can be transmitted to the computer 100 via a wire 98 connected to the base 92. The fixture 1 of the present invention utilizes external characteristics of the USB connector 90 to fix the USB connector 90.

Fixture 1 comprises a housing connection surface 10, a top surface 20, a first lateral surface 30, and a second lateral surface 40, wherein the top surface 20, the first lateral surface 30, and the second lateral surface 40 form an "n" shape for accommodating the USB connector 90.

The housing connection surface 10 comprises a fixing hole 12 and an alignment part 14. The housing connection surface 10 can be fixed on the housing by fastening a screw 60 (as shown in FIG. 2) through the fixing hole 12. The alignment part 14 corresponds to a bump 84 (as shown in FIG. 2) of the housing 80. When the housing connection surface 10 is fixed on the housing 80, the alignment part 14 contacts the bump 84 for alignment. The shape and quantity of the alignment part 14 are not limited by the above description.

The top surface 20 is connected to the housing connection surface 10, and the top surface 20 and the housing connection surface 10 are substantially perpendicular to each other. The top surface 20 comprises a first constraining unit 22 capable of contacting the protection part 96 of the USB connector 90. The first constraining unit 22 and the protection part 96 can hold each other to constrain movement of the USB connector 90 along a first direction (the X-axis as shown in FIG. 4). In addition, when the first constraining unit 22 contacts the protection part 96, the screening effect due to electromagnetic interference can be reduced.

In the embodiment of the present invention, the first constraining unit 22 is in a strip shape, corresponding to the protection part 96, and the first constraining unit 22 is substantially perpendicular to the top surface 20. The strip-shaped first constraining unit 22 can increase the contact area with the protection part 96 to improve the fixing effect. When the first constraining unit 22 contacts the protection part 96, the protection part 96 is located on the outer side of the first constraining unit 22 (as shown in FIG. 4). The protection part 96 is stopped by the first constraining unit 22 and therefore constrains movement of the USB connector 90 along the first direction (the X-axis as shown in FIG. 4). The shape of the first constraining unit 22 is not limited by the above description.

In addition, in order to strengthen the structure of the top surface 20, the top surface 20 of the present embodiment further comprises a reinforced rib 24.

In the present embodiment, the first lateral surface 30 is substantially perpendicular to the top surface 20. The first lateral surface 30 comprises a first stop part 32 and a second stop part 34, and both stop parts 32, 34 are in a plate shape, wherein the first stop part 32 is capable of contacting the side edge 922 of the base 92 to constrain movement of the base 92 along the Y-axis.

When the USB connector 90 is fixed by the fixture 1, the first stop part 32 and the base 92 are tightly matched, and the first stop part 32 is capable of clipping on the side edge 922 of the base 92 for a tighter fix. The structure of the first stop part 32 is not limited by the above description. In addition, the first stop part 32 is not always necessary if the fixture 1 already meets the fixing requirement.

The second stop part 34 is capable of constraining movement of the connection part 94 along the Y-axis. There is a step between the first stop part 32 and the second stop part 34, and thus the second stop part 34 comprises a stop edge 342. The stop edge 342 is capable of contacting a front edge 924 (as shown in FIG. 4) of the base 92, and since the stop edge 342 is on the left side of the front edge 924, the front edge 924 of the base 92 is stopped by the stop edge 342 to constrain movement of the USB connector along the second direction (the X-axis as shown in FIG. 4), wherein the first direction is substantially opposite to the second direction.

In order to improve the fixing effect, the second stop part 34 further comprises a second constraining unit 344 to constrain movement of the USB connector 90 along the first direction (the X-axis as shown in FIG. 4). The second constraining unit 344 is capable of contacting the protection part 96*a* of the USB connector 90. The second constraining unit 344 and the protection part 96*a* can hold each other to constrain movement of the USB connector 90 along the first direction (the X-axis as shown in FIG. 4). In addition, when the second constraining unit 344 contacts the protection part 96*a*, the screening effect due to electromagnetic interference can be reduced.

In the present embodiment, the second constraining unit 344 is concave. When the second constraining unit 344 contacts the protection part 96*a*, the protection part 96*a* is located at the left side of the second constraining unit 344 (as shown in FIG. 4). In addition, since the protection part 96*a* is stopped by the second constraining unit 344, the movement of the USB connector 90 along the first direction (X-axis as shown in FIG. 4) is constrained. In addition, the second constraining unit 344 also can provide clipping force on the connection part 94.

The second stop part 34 further comprises a contact part 346. In the present embodiment, the contact part 346 is concave and capable of contacting the connection part 94. The contact part 346 also can provide clipping force on the connection part 94. In addition, when the contact part 346 contacts the connection part 94, the screening effect due to the electromagnetic interference can be reduced.

When the USB connector 90 is fixed by the fixture 1, the second constraining unit 344 and the contact part 346 of the second stop part 34 are tightly clipped on the connection part 94. The shape and quantity of the second constraining unit 344 are not limited by the above description. In addition, the second constraining unit 344 and/or the contact part 346 of the second stop part 34 are not always necessary if the fixture 1 already meets the requirement for fixing or reducing the screening effect.

Furthermore, the first stop part 32 and the second stop part 34 can be connected together, and the shape of the first lateral surface 30 needs to correspond to the base 92 and the connection part 94.

The second lateral surface 40 of the fixture 1 is connected to the top surface 20, and the second lateral surface 40 is capable of constraining movement of the USB connector 90 along the Y-axis. The first lateral surface 30 and the second lateral surface 40 are at opposite sides of the top surface 20. Also, the second lateral surface 40 has the same structure as the first lateral surface 30; therefore, the details of the second lateral surface 40 are not described further.

Although the present invention has been explained in relation to its preferred embodiments, it is to be understood that many other possible modifications and variations can be made without departing from the spirit and scope of the invention as hereinafter claimed.

What is claimed is:

1. A fixture for fixing a USB connector on a housing, the USB connector comprising a base, a connection part, and a protection part, the fixture comprising:

a housing connection surface capable of being fixed on the housing;

a top surface connected to the housing connection surface, the top surface and the housing connection surface being perpendicular to each other, the top surface comprising a first constraining unit capable of contacting with the protection part to constrain movement of the USB connector along a first direction;

a first lateral surface directly connected to the top surface for constraining movement of the USB connector; and a second lateral surface directly connected to the top surface for constraining movement of the USB connector, wherein the first lateral surface further comprises a first stop part to constrain movement of the base and a second stop part to constrain movement of the connection part, and wherein the first stop part is a plate and the second stop part is a plate.

2. The fixture as claimed in claim 1, wherein the first constraining unit is in a strip shape.

3. The fixture as claimed in claim 2, wherein when the first constraining unit contacts the protection part, the protection part is located on the outer side of the first constraining unit.

4. The fixture as claimed in claim 1, wherein the first stop part is capable of clipping on the base.

5. The fixture as claimed in claim 1, wherein the second stop part comprises a stop edge capable of contacting the base to constrain movement of the USB connector along a second direction, and the first direction is substantially opposite to the second direction.

6. The fixture as claimed in claim 5, wherein the base comprises a front edge, the first stop part and the second stop part are in a plate shape, and there is a step between the first stop part and the second stop part; the stop edge is capable of contacting the front edge to constrain movement of the USB connector along the second direction.

7. The fixture as claimed in claim 1, wherein the second stop part further comprises a second constraining unit capable of constraining movement of the USB connector along the first direction.

8. The fixture as claimed in claim 7, wherein the second constraining unit is capable of clipping on the connection part.

9. The fixture as claimed in claim 7, wherein the second constraining unit is concave.

10. The fixture as claimed in claim 1, wherein the second stop part further comprises a contact part capable of contacting the connection part.

11. The fixture as claimed in claim 10, wherein the contact part is concave and capable of clipping on the connection part.

12. The fixture as claimed in claim 1, wherein the housing connection surface further comprises a fixing hole.

13. The fixture as claimed in claim 12, wherein the housing connection surface further comprises at least one alignment part having a semicircle shape.

14. The fixture as claimed in claim 1, wherein the top surface further comprises a raised reinforcing rib.

15. The fixture as claimed in claim 5, wherein the housing connection surface further comprises a fixing hole and at least one alignment part.

16. The fixture as claimed in claim 1, wherein the top surface, the first lateral surface, and the second lateral surface form an “n” shape.

* * * * *